US010034531B2

(12) United States Patent
Lee et al.

(10) Patent No.: US 10,034,531 B2
(45) Date of Patent: Jul. 31, 2018

(54) COMPACT FOR COSMETICS HAVING REFILL CASE

(71) Applicant: NEWFRONTECH CO., LTD., Gunpo-si (KR)

(72) Inventors: Yong-jun Lee, Seongnam-si (KR); Jin-gee Kim, Suwon-si (KR)

(73) Assignee: Newfrontech Co., LTD., Gunpo-si (KR)

( * ) Notice: Subject to any disclaimer, the term of this patent is extended or adjusted under 35 U.S.C. 154(b) by 171 days.

(21) Appl. No.: 15/040,329

(22) Filed: Feb. 10, 2016

(65) Prior Publication Data

US 2016/0235184 A1 Aug. 18, 2016

(30) Foreign Application Priority Data

Feb. 17, 2015 (KR) ..... 10-2015-0023807
Jun. 19, 2015 (KR) ..... 10-2015-0087106

(51) Int. Cl.
*A45D 33/02* (2006.01)
*A45D 40/22* (2006.01)
(Continued)

(52) U.S. Cl.
CPC ..... *A45D 40/22* (2013.01); *A45D 33/006* (2013.01); *A45D 33/24* (2013.01); *A45D 34/00* (2013.01); *B65D 43/02* (2013.01); *B65D 43/16* (2013.01); *B65D 51/18* (2013.01); *B65D 2251/009* (2013.01); *B65D 2251/0018* (2013.01); *B65D 2251/0028* (2013.01); *B65D 2251/0084* (2013.01); *B65D 2543/00435* (2013.01)

(58) Field of Classification Search
CPC .... A45D 33/00; A45D 33/003; A45D 33/005; A45D 33/006; A45D 33/02; A45D 33/025; A45D 33/06; A45D 33/16; A45D 34/00; A45D 40/22; B65D 43/02; B65D 2543/00435; A65D 2251/0018; A65D 2251/0028; A65D 2251/0084; A65D 2251/009
See application file for complete search history.

(56) References Cited

U.S. PATENT DOCUMENTS

2003/0140936 A1* 7/2003 Yuhara ..... A45D 33/003 132/307
2007/0029226 A1* 2/2007 Yuhara ..... A45D 33/006 206/581

* cited by examiner

*Primary Examiner* — Rachel Steitz
(74) *Attorney, Agent, or Firm* — Schmeiser, Olsen & Watts LLP

(57) ABSTRACT

The present invention relates to a compact for cosmetics comprising an upper case, a lower case rotatably coupled to the upper case and a refill case detachably received in the lower case, wherein the refill case comprises a case mainbody where contents for cosmetics are received; a case cover which opens and closes the case mainbody; and a mesh screen cover having a border rim part which is received in the case mainbody to be tightly received within a wall of the mainbody, and a high elasticity mesh screen which has a border area supported by the border rim part to extend inwardly so as to cover the contents for cosmetics from an outside. Accordingly, expanded space is provided for receiving contents for cosmetics, the contents for cosmetics is prevented from flowing out of the refill case by the high elasticity mesh screen covering the contents for cosmetics, and the contents for cosmetics is prevented from being directly exposed to the outside thus decreasing vaporization when the case is open.

9 Claims, 10 Drawing Sheets

(51) Int. Cl.

| | |
|---|---|
| ***B65D 43/02*** | (2006.01) |
| ***B65D 43/16*** | (2006.01) |
| ***B65D 51/18*** | (2006.01) |
| ***A45D 33/00*** | (2006.01) |
| ***A45D 33/24*** | (2006.01) |
| ***A45D 34/00*** | (2006.01) |

【Fig. 1】
(Prior Art)
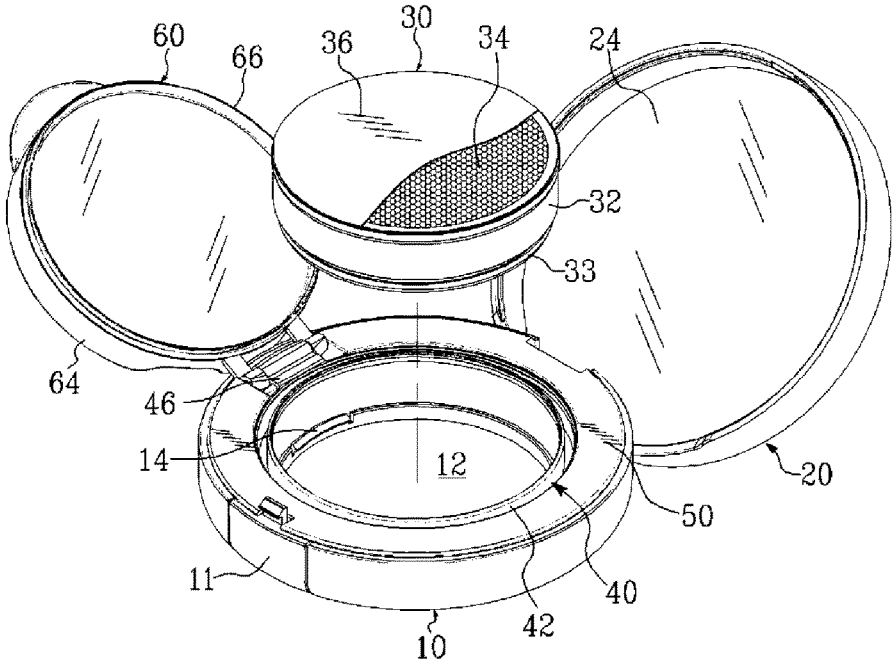

【Fig. 2】
(Prior Art)
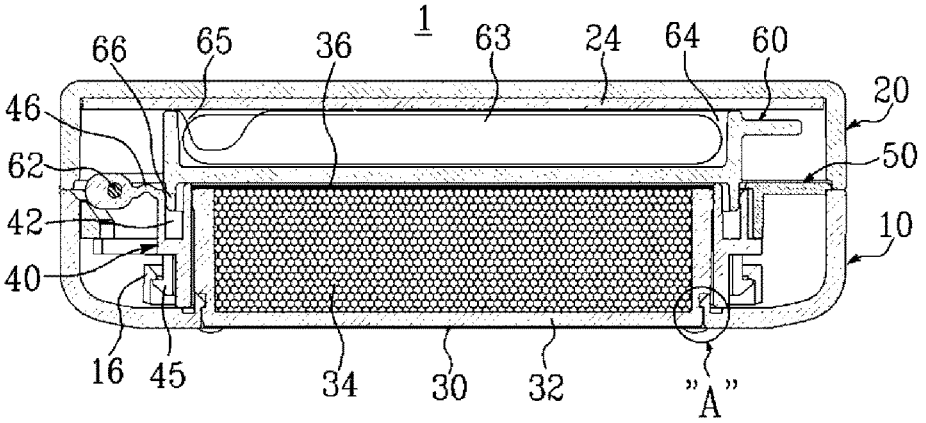

【Fig. 3】
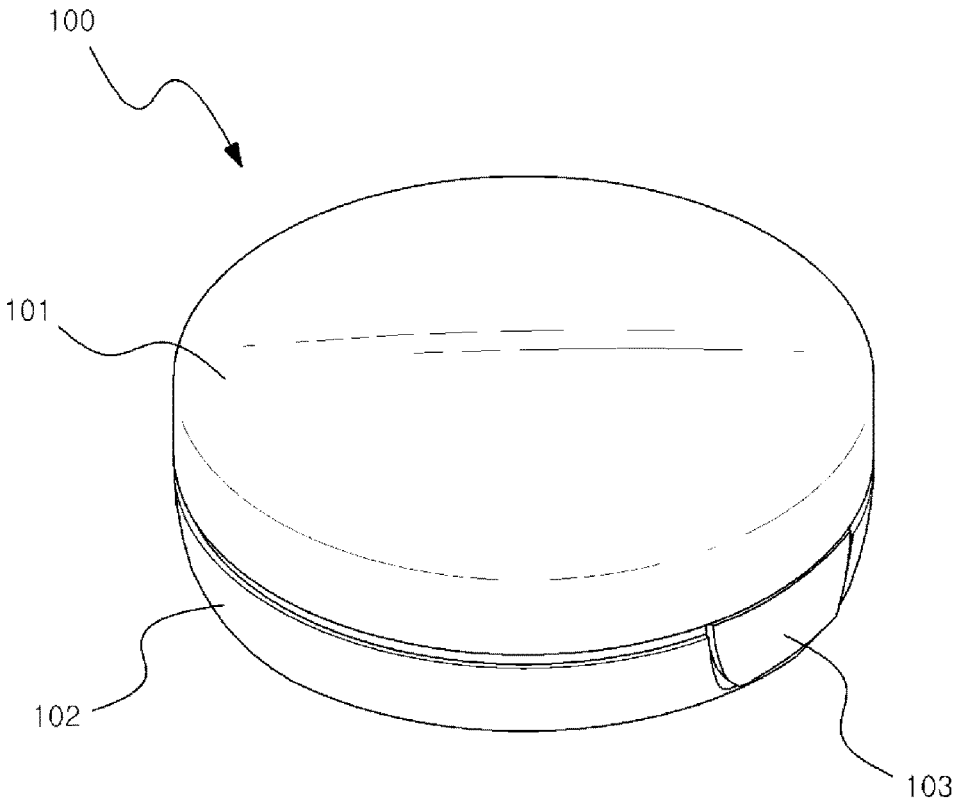

【Fig. 4】
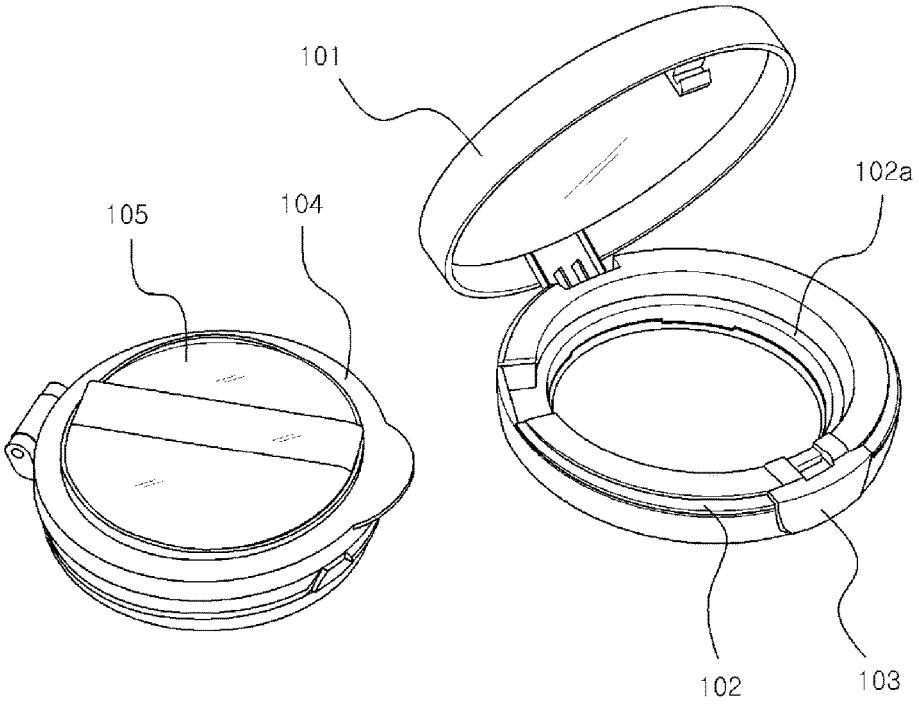

【Fig. 5】
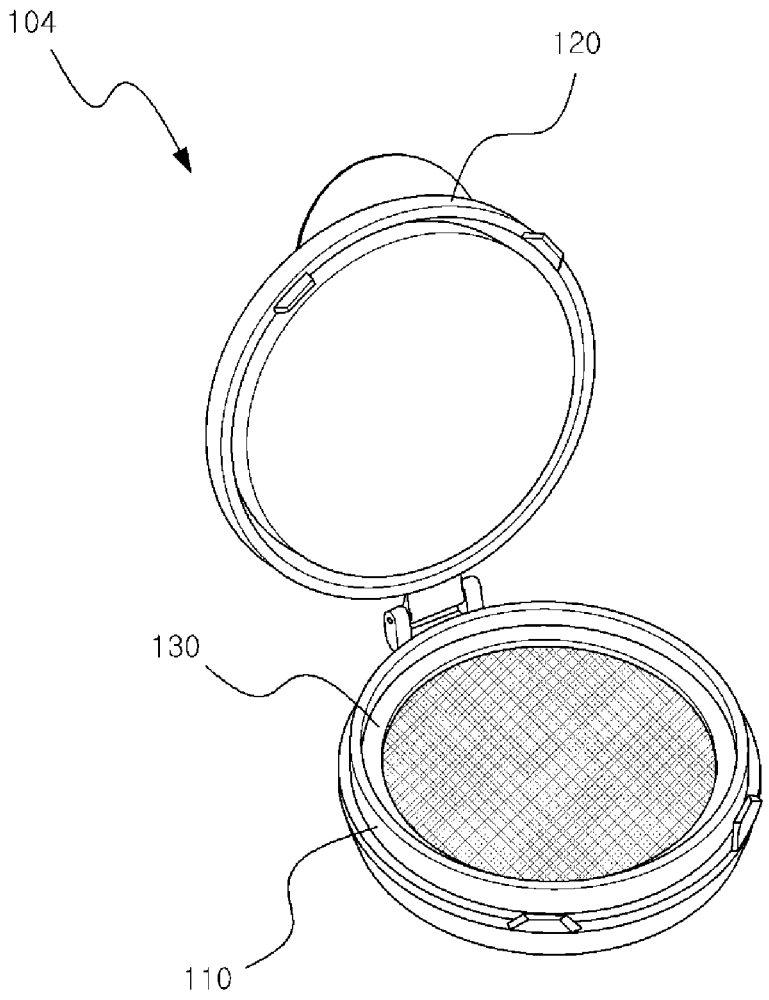

【Fig. 6】
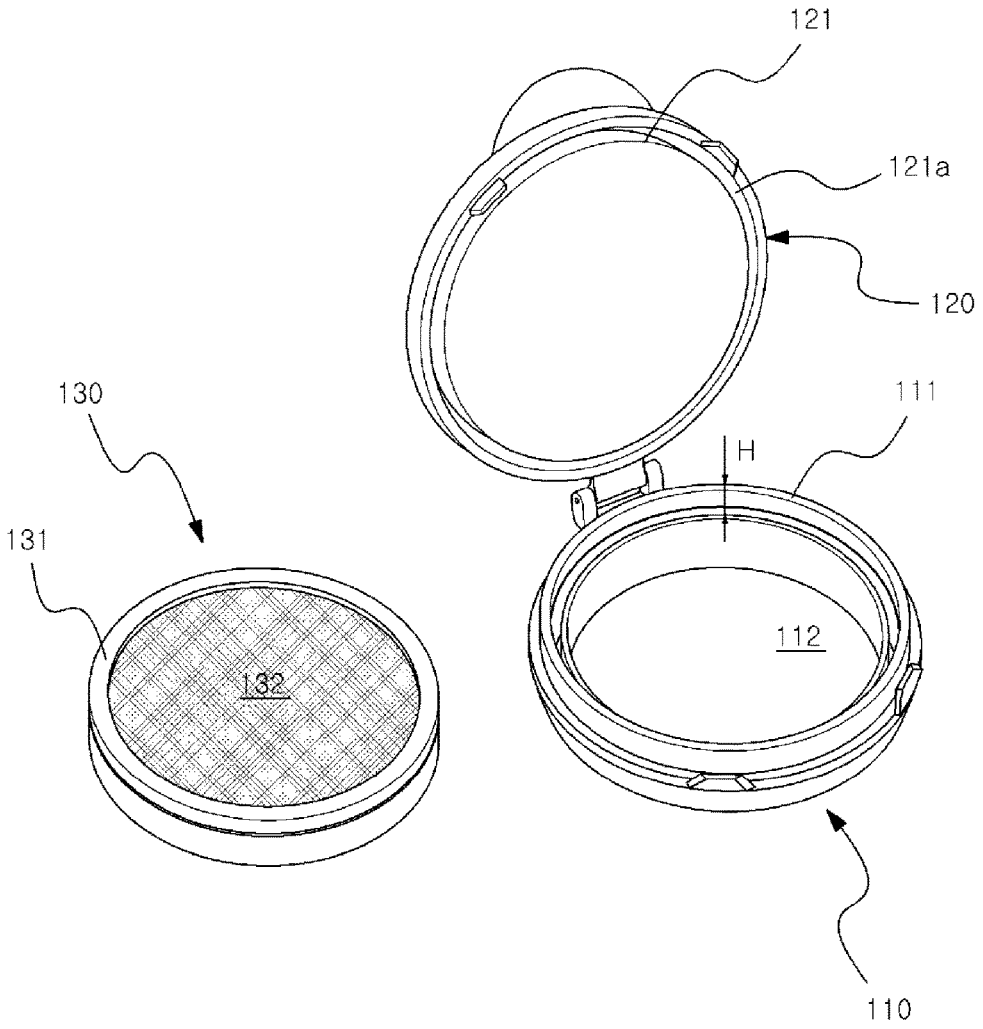

【Fig. 7】
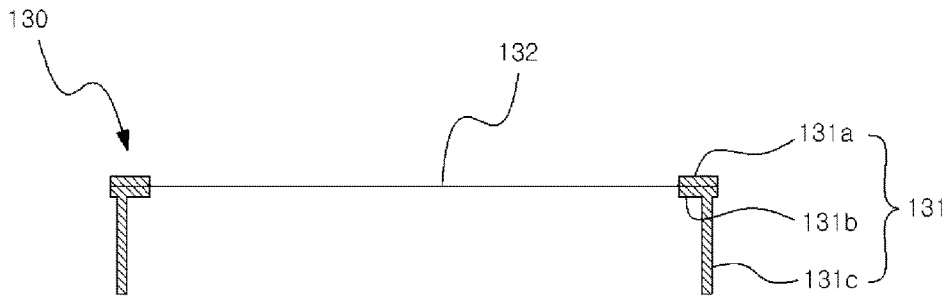
【Fig. 8】
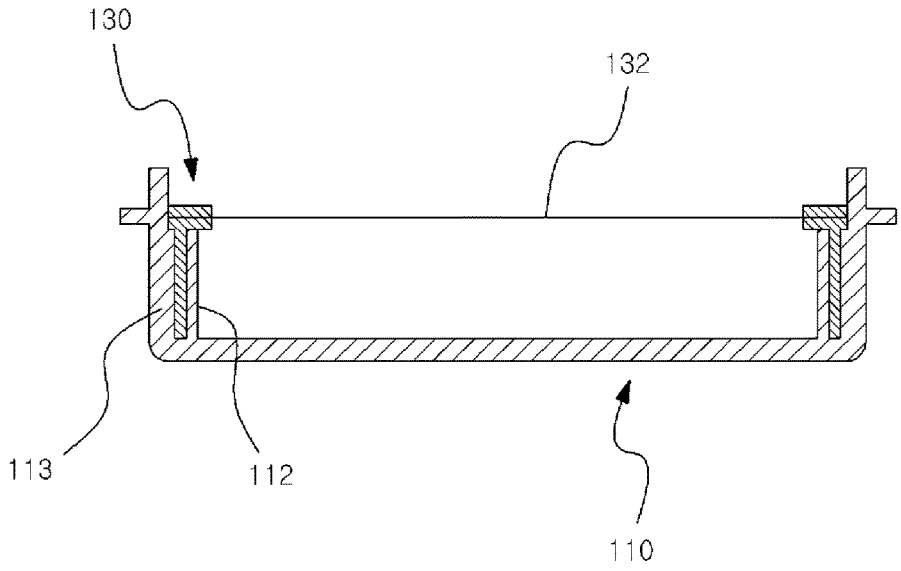

【Fig. 9】
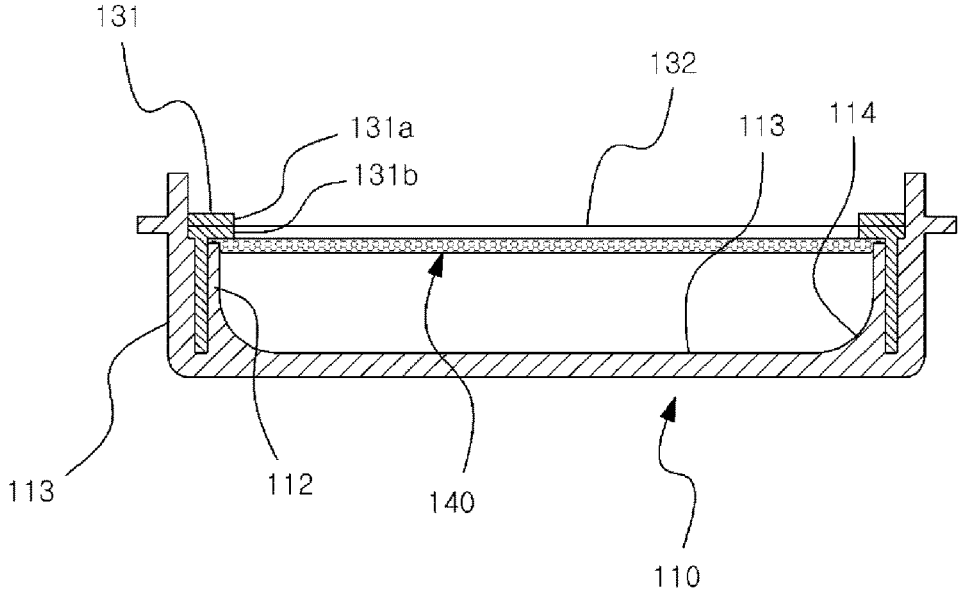

【Fig. 10】
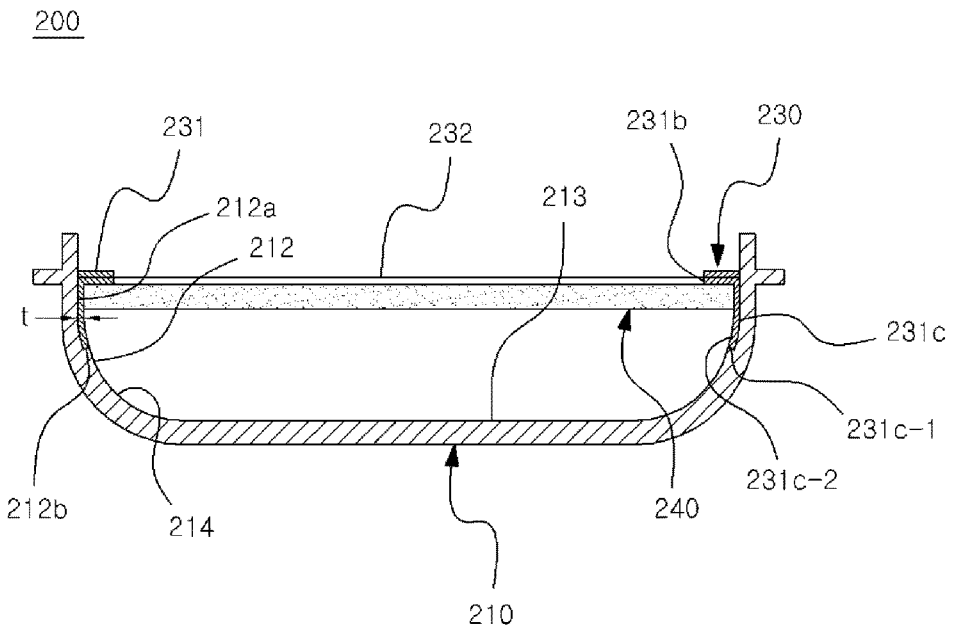

【Fig. 11】
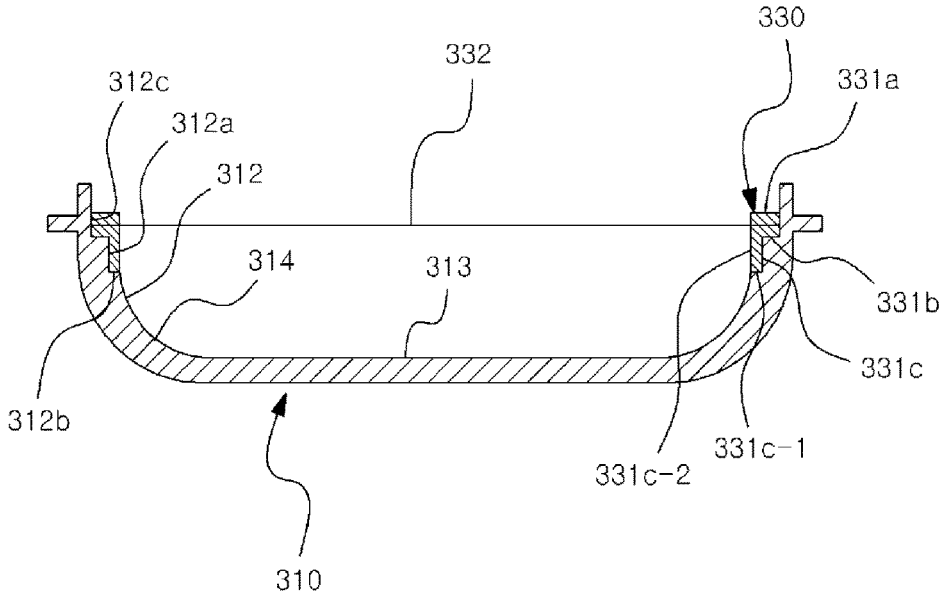

COMPACT FOR COSMETICS HAVING REFILL CASE

TECHNICAL FIELD

The present invention relates to a compact for cosmetics where a refill case is detachably received and more particularly to a compact for cosmetics having a refill case which provides enhanced storage condition of contents for cosmetics received therein.

BACKGROUND ART

Referring to FIG. 1 and FIG. 2, a conventional compact for cosmetics having refill case 1 has a porous pad such as a sponge and a urethane foam received in a refill case 30 to hold content, that is, liquid cosmetic substance therein. A sealing member 36 is opened and removed when the compact 1 is used at first after it has been bought.

However, as the liquid cosmetic substance actually received in an inner space of the refill case 30 is only that can be held in the pad 34 according the conventional compact for cosmetics 1, a comparably small amount of the liquid cosmetic substance can be received in the refill case 30.

In this case, if the pad 34 is removed for receiving more liquid cosmetic substance directly in the refill case 30, the liquid cosmetic substance will flow out while using it or its vaporization will increase because it is directly exposed to an outside when the case 30 is open.

DISCLOSURE

Technical Problem

Accordingly, it is object of the present invention to provide a compact for cosmetics having refill case which provides enhanced storage condition of contents for cosmetics received therein and expanded space for receiving more contents in comparison with the conventional art.

Technical Solution

In order to accomplish the above object, the present invention provides a compact for cosmetics comprising an upper case, a lower case rotatably coupled to the upper case and a refill case detachably received in the lower case, wherein the refill case comprises a case mainbody where contents for cosmetics are received; a case cover which opens and closes the case mainbody; and a mesh screen cover having a border rim part which is received in the case mainbody to be tightly received within a wall of the mainbody, and a high elasticity mesh screen which has a border area supported by the border rim part to extend inwardly so as to cover the contents for cosmetics from an outside.

According to an aspect of the present invention, the border rim part of the mesh screen cover comprises an upper ring part which supports the high elasticity mesh screen at an upper side, a lower ring part which supports the high elasticity mesh screen at a lower side to be symmetrical with the upper ring part, and a vertically extending ring part which extends vertically from a lower side of the lower ring part to be tightly contact an inner wall of the case mainbody, and the upper ring part, the lower ring part and the vertically extending ring part are integrally formed with the high elasticity mesh screen by injection molding.

According to an aspect of the present invention, the case mainbody has an inner wall which makes an inner space to receive the contents for cosmetics and an outer wall which is formed to have a predetermined gap with the inner wall, and the vertically extending ring part is inserted between the inner wall and the outer wall to be tightly received therein.

According to an aspect of the present invention, the compact for cosmetics further comprises a sponge cover which is disposed between an upper end of the inner wall and the lower ring part of the border rim part to cover the contents for cosmetics from the outside.

According to an aspect of the present invention, the case mainbody has an inner wall, and the inner wall has a ring recess part which has a width to correspond to a thickness of the vertically extending ring part and which extends in a circular direction, the vertically extending ring part is tightly received in the ring recess part and its inner surface coincides with the inner wall of the case mainbody.

According to an aspect of the present invention, the case mainbody has an intermediate round surface between the inner wall and a bottom surface.

According to an aspect of the present invention, the compact for cosmetics further comprises a sponge cover which is received within the vertically extending ring part and supported by the border rim part at its border area, so that it covers the contents for cosmetics from the outside.

According to an aspect of the present invention, the vertically extending ring part extends vertically from an inner end of the lower ring part, the case mainbody has an inner wall, the inner wall has a ring recess part which has a width to correspond to a thickness of the vertically extending ring part and which extends in a circular direction, the vertically extending ring part is tightly received in the ring recess part and its inner surface coincides with the inner wall of the case mainbody, and the inner wall of the case mainbody has a second ring recess part at an upper side of the ring recess part to have a longer radius than the ring recess part, the upper ring part and the lower ring part are tightly received in the second ring recess part.

According to an aspect of the present invention, the case mainbody has an elastomer tip part along an upper open rim to protrude in an axial direction to a predetermined height, the case cover has a channel groove part along its circumference to receive the elastomer tip part, and a silicon sealing part is formed along a bottom surface of the channel groove part to closely contact the elastomer tip part.

According to an aspect of the present invention, the high elasticity mesh screen is a fabric knitted with spandex yarn and polyester yarn or a fabric knitted with spandex yarn and nylon yarn.

Advantageous Effects

According to the compact for cosmetics having refill case of the present invention as described above, the contents for cosmetics such as liquid substance is not held in the conventional porous pad but directly received in the refill case. Therefore, the contents for cosmetics received in the refill case can be much increased.

In this case, the contents for cosmetics can be used by pressing a puff onto a high elasticity mesh screen of a mesh screen cover which is tightly received in a case mainbody of the refill case and thus taking the contents for cosmetics off from the high elasticity mesh screen while they are passing through the high elasticity mesh screen.

According to such structure of the high elasticity mesh screen covering the contents for cosmetics, the contents for cosmetics can be prevented from flowing out of the refill case. Also, vaporization of the contents for cosmetics will much decrease because it is prevented from being directly exposed to the outside when the case is open.

DESCRIPTION OF DRAWINGS

FIG. 1 is a perspective view of a conventional compact for cosmetics in an open state;

FIG. 2 is a sectional view of the compact for cosmetics in FIG. 1 in an assembled state;

FIG. 3 is a perspective view of a compact for cosmetics according to an exemplary embodiment of the present invention;

FIG. 4 is a perspective view of the compact for cosmetics in FIG. 3 where a refill case is separated;

FIG. 5 is a perspective view of the refill case in FIG. 4 in its open state;

FIG. 6 is a perspective view of the refill case of FIG. 5 where a mesh screen cover is separated;

FIG. 7 is a sectional view of the mesh screen cover in FIG. 6;

FIG. 8 is a sectional view of a mainbody of the refill case and the mesh screen cover in FIG. 6 in an assembled state therebetween;

FIG. 9 is the sectional view of FIG. 8 where a sponge cover is additionally assembled;

FIG. 10 is a sectional view of a modification of the mesh screen cover of FIG. 7 and a mainbody of a refill case in an assembled state therebetween; and FIG. 11 is a sectional view of another modification of the mesh screen cover of FIG. 7 and a mainbody of a refill case in an assembled state therebetween.

BEST MODE

As shown in FIG. 3, a compact for cosmetics 100 according to an exemplary embodiment of the present invention comprises an upper case 101 and a lower case 102 rotatably coupled to the upper case 101. When a push button 103 is pushed, the upper case 101 can be rotated to be open as shown in FIG. 4. A refill case 104 which is received in a receiving part 102*a* of the lower case 102 can be separated and extracted from the receiving part 102*a*.

The refill case 104 comprises a case mainbody 110 where contents for cosmetics in the form of liquid, powder, solidified powder or etc. are received and a case cover 120 for opening and closing the case mainbody 110.

As shown in FIG. 5 and FIG. 6, the case mainbody 110 has an elastomer tip part 111 along an upper open rim to protrude in an axial direction to a predetermined height H. Correspondingly, the case cover 120 has a channel groove part 121 along its circumference to receive the elastomer tip part 111.

In this case, a silicon sealing part 121*a* is formed along a bottom surface of the channel groove part 121 to closely contact the elastomer tip part 111 so as to enhance performance in sealing an inner space of the case mainbody 110.

The case mainbody 110 has an inner wall 112 which defines the inner space to receive the contents for cosmetics and an outer wall 113 which is formed with a predetermined gap from the inner wall 112. The outer wall 113 also forms an outer shape of the case mainbody 110.

A mesh screen cover 130 is received in the case mainbody 110.

As shown in FIG. 6 and FIG. 7, the mesh screen cover 130 comprises a border rim part 131 and a high elasticity mesh screen 132 which is supported by the border rim part 131 to extend inwardly.

To describe in detail, the border rim part 131 has an upper ring part 131*a* which supports the high elasticity mesh screen 132 at an upper side, a lower ring part 131*b* which supports the high elasticity mesh screen 132 at a lower side to be symmetrical with the upper ring part 131*a*, and a vertically extending ring part 131*c* which extends vertically from a lower outer end part of the lower ring part 131*b*.

Structure of such a border rim part 131 can be made by injection molding. Especially, whole cloth of the high elasticity mesh screen 132 is interposed between an upper mold and a lower. Then, the upper mold and the lower mold are combined and molten resin is injected to integrally form the border rim part 131 and the whole cloth.

Thereafter, the upper and the lower mold are separated therebetween and the whole cloth is cut along an outer circumference of the border rim part 131 so as to get the mesh screen cover 130 in a form of integration of the border rim part 131 and the high elasticity mesh screen 132.

When the mesh screen cover 130 formed as described above is received in the case mainbody 110, the vertically extending ring part 131*c* is inserted between the inner wall 112 and the outer wall 113 and tightly interposed therebetween so that the contents for cosmetics received in the inner space of the inner wall 112 cannot flow out through between the vertically extending ring part 131*c* and the walls 112, 113.

Also, the high elasticity mesh screen 132 prevents the contents for cosmetics from being directly exposed to an outside of the case mainbody 110.

Accordingly, the contents for cosmetics can be used by pressing a puff (refer to 105 in FIG. 4) onto the high elasticity mesh screen 132 when the case cover 120 is open and thus taking the contents for cosmetics off from the high elasticity mesh screen 132 while they are passing through the high elasticity mesh screen 132. At the same time, speed of vaporization of the contents for cosmetics can be much decrease.

Usually, the contents for cosmetics received in the case mainbody 110 contain a lot of fat and moisture. However, they are not totally liquid like skin toner but similar to high viscosity liquid substance such as cosmetic cream, so that they can be prevented from flowing out by using the high elasticity mesh screen 132.

Also, as the contents for cosmetics are used by pressing the puff 105 onto the high elasticity mesh screen 132, it is possible to take a proper amount as needed by adjusting pressing pressure onto the high elasticity mesh screen 132 such as shown in the conventional art where the contents for cosmetics contained in the pad (refer to 34 in FIG. 1 and FIG. 2) are taken by pressing the pad. Material of such a high elasticity mesh screen 132 may be a fabric knitted with spandex yarn and polyester yarn, a fabric knitted with spandex yarn and nylon yarn or etc.

Moreover, to prevent damage of the high elasticity mesh screen 132 due to excessive deformation while it is being pressed as well as to further prevent the contents for cosmetics from flowing out, as shown in FIG. 9, a sponge cover 140 is disposed between an upper end of the inner wall 112 and the lower ring part 131*b* of the border rim part 131 and its circular border area is fixed by pressing the border rim part 131.

According to addition of such a sponge cover 140, if the contents for cosmetics received in the case mainbody 110 are liquid substance, the sponge cover 140 will contain some of the contents in case that a user presses the high elasticity mesh screen 132 by using the puff or all of the compact 100 is inclined or turned over. Then, the user can use the contents contained in the sponge cover 140 by opening the case cover (refer to 120 in FIG. 5) and pressing the puff through the high elasticity mesh screen 132.

That is, as the contents for cosmetics are used by pressing the puff onto the high elasticity mesh screen 132 and the sponge cover 140, it is possible to take similar amount of the contents as in the conventional art where the amount is taken from the pad (refer to 34 in FIG. 1 and FIG. 2).

The sponge cover 140 may be provided with its upper circular border area glued onto a lower surface of the lower ring part 131*b* of the border rim part 131 by using the adhesive and etc.

In FIG. 9, the case mainbody 110 has an intermediate round surface 114 between the inner wall 112 and a bottom surface part 113, so that the contents for cosmetics in the case mainbody 110 can be prevented from being stagnating in corners thus causing it hard to be taken with the puff through the high elasticity mesh screen 132.

FIG. 10 shows a modification of the mesh screen cover and the case mainbody. A case mainbody 210 has only one wall 212 which has at an upper end part a ring recess part 212*a* extending in a circular direction to tightly receive a vertically extending ring part 231*c* as seen the drawing.

The ring recess part 212*a* has a width of t that is thickness of the vertically extending ring part 231*c*, so that it makes a step 212*b* with a wall 212 of the case mainbody 210. A lower end surface 231*c*-1 of the vertically extending ring part 231*c* that is tightly received in the ring recess part 212*a* tightly contacts the step 212*b*.

Consequently, an inner surface 231*c*-2 of the vertically extending ring part 231*c* that is tightly received in the ring recess part 212*a* coincides with the wall 212 of the case mainbody 210 to make a continuous round surface.

Also, the case mainbody 210 has an intermediate round surface 214 between the wall 212 and a bottom surface 213.

Therefore, the contents for cosmetics in the case mainbody 210 can be prevented from being stagnating in corners thus causing it hard to be taken with the puff through a high elasticity mesh screen 232.

A sponge cover 240 is supported on a lower surface of a lower ring part 231*b* of a mesh screen cover 230, so that inner space of the case mainbody 210 is doubly covered by the sponge cover 240 and the mesh screen 232.

In this case, the sponge cover 240 can be supported by its upper border area being glued on a lower surface of the lower ring part 231*b*.

FIG. 11 shows another modification of the mesh screen cover and the case mainbody. A mesh screen cover 330 has an upper ring part 331*a* which supports a border area of a high elasticity mesh screen 332 at an upper side, a lower ring part 331*b* which supports the border area of the high elasticity mesh screen 332 at a lower side to be symmetrical with the upper ring part 331*a*, and a vertically extending ring part 331*c* which extends vertically from an inner end of the lower ring part 331*b*.

Correspondingly, a case mainbody 310 has a wall 312 which has a ring recess part 312*a* extending in a circular direction to have a width to correspond to thickness of the vertically extending ring part 331*c* so that it makes a step 312*b* with the wall 312. Therefore, the vertically extending ring part 331*c* is tightly received in the ring recess part 312*a* and a lower end surface 331*c*-1 of the vertically extending ring part 331*c* tightly contacts the step 312*b*. Also, an inner surface 331*c*-2 of the vertically extending ring part 331*c* coincides with the wall 212 of the case mainbody 310.

Furthermore, the wall 312 of the case mainbody 310 has a second ring recess part 312*c* at an upper side of the ring recess part 312*a* to have a longer radius.

The upper ring part 331*a* and the lower ring part 331*b* are tightly received in the second ring recess part 312*c*.

Also, the case mainbody 310 has an intermediate round surface 314 between the wall 312 and a bottom surface 313.

Therefore, the contents for cosmetics in the case mainbody 310 can be prevented from being stagnating in corners thus causing it hard to be taken with the puff through the high elasticity mesh screen 332.

Although the compact for cosmetics 100 and the components according to the exemplary embodiments of the present invention have been disclosed, various modifications, additions and substitutions are possible, without departing from the scope and spirit of the invention.

Therefore, the above embodiments must be regarded as one example provided for description of the present invention, rather than to limit the present invention.

The invention claimed is:

1. A compact for cosmetics comprising an upper case, a lower case rotatably coupled to the upper case and a refill case detachably received in the lower case, wherein the refill case comprises a case mainbody where contents for cosmetics are received;

a case cover which opens and closes the case mainbody; and a mesh screen cover having a border rim part which is received in the case mainbody to be tightly received within a wall of the mainbody, and a high elasticity mesh screen which has a border area supported by the border rim part to extend inwardly so as to cover the contents for cosmetics from an outside;

wherein the border rim part of the mesh screen cover comprises an upper ring part which supports the high elasticity mesh screen at an upper side, a lower ring part which supports the high elasticity mesh screen at a lower side to be symmetrical with the upper ring part, and a vertically extending ring part which extends vertically from a lower side of the lower ring part to be tightly contact an inner wall of the case mainbody, and the upper ring part, the lower ring part and the vertically extending ring part are integrally formed with the high elasticity mesh screen by injection molding.

2. The compact for cosmetics according to claim 1 wherein the case mainbody has an inner wall which makes an inner space to receive the contents for cosmetics and an outer wall which is formed to have a predetermined gap with the inner wall, and the vertically extending ring part is inserted between the inner wall and the outer wall to be tightly received therein.

3. The compact for cosmetics according to claim 2 further comprising a sponge cover which is disposed between an upper end of the inner wall and the lower ring part of the border rim part to cover the contents for cosmetics from the outside.

4. The compact for cosmetics according to claim 1 wherein the case mainbody has an inner wall, and the inner wall has a ring recess part which has a width to correspond to a thickness of the vertically extending ring part and which extends in a circular direction, the vertically extending ring part is tightly received in the ring recess part and its inner surface coincides with the inner wall of the case mainbody.

5. The compact for cosmetics according to claim 2 or claim 4 wherein the case mainbody has an intermediate round surface between the inner wall and a bottom surface.

6. The compact for cosmetics according to claim 4 further comprising a sponge cover which is received within the vertically extending ring part and supported by the border rim part at its border area, so that it covers the contents for cosmetics from the outside.

7. The compact for cosmetics according to claim 1 wherein the vertically extending ring part extends vertically from an inner end of the lower ring part, the case mainbody has an inner wall, the inner wall has a ring recess part which has a width to correspond to a thickness of the vertically extending ring part and which extends in a circular direction, the vertically extending ring part is tightly received in the ring recess part and its inner surface coincides with the inner wall of the case mainbody, and the inner wall of the case mainbody has a second ring recess part at an upper side of the ring recess part to have a longer radius than the ring recess part, the upper ring part and the lower ring part are tightly received in the second ring recess part.

8. The compact for cosmetics according to claim 1 wherein the case mainbody has an elastomer tip part along an upper open rim to protrude in an axial direction to a predetermined height, the case cover has a channel groove part along its circumference to receive the elastomer tip part, and a silicon sealing part is formed along a bottom surface of the channel groove part to closely contact the elastomer tip part.

9. The compact for cosmetics according to claim 1 wherein the high elasticity mesh screen is a fabric knitted with spandex yarn and polyester yarn or a fabric knitted with spandex yarn and nylon yarn.

* * * * *